US008485223B2

(12) United States Patent
Ku

(10) Patent No.: US 8,485,223 B2
(45) Date of Patent: Jul. 16, 2013

(54) HYDRAULIC CONTROL VALVE

(75) Inventor: Bon Seuk Ku, Changwon-si (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 396 days.

(21) Appl. No.: 12/815,459

(22) Filed: Jun. 15, 2010

(65) Prior Publication Data

US 2011/0088789 A1 Apr. 21, 2011

(30) Foreign Application Priority Data

Oct. 20, 2009 (KR) ..... 10-2009-0099880

(51) Int. Cl.
*F15B 13/04* (2006.01)

(52) U.S. Cl.
USPC ..... 137/596.18; 137/596; 137/596.14; 137/625.69

(58) Field of Classification Search
USPC ..... 137/596, 596.18, 596.14, 596.1, 137/596.2; 91/464; 60/468
See application file for complete search history.

(56) References Cited

U.S. PATENT DOCUMENTS 3,087,307 A * 4/1963 Faisandier ..... 91/530
3,303,647 A * 2/1967 Futamata ..... 60/433
3,748,859 A * 7/1973 Pruvot ..... 60/464
3,926,210 A * 12/1975 Rasmussen ..... 137/491
5,361,584 A * 11/1994 Langen et al. ..... 60/460
5,682,744 A * 11/1997 Hasegawa et al. ..... 60/385
6,095,187 A * 8/2000 Hotchkiss ..... 137/596.17
6,339,929 B1 * 1/2002 Udagawa et al. ..... 60/468
6,871,574 B2 * 3/2005 Barber ..... 91/420
7,263,924 B2 * 9/2007 Ioku ..... 91/447
2006/0021341 A1 * 2/2006 Zitterbart ..... 60/468
2006/0064974 A1 * 3/2006 Whitaker et al. ..... 60/468

* cited by examiner

*Primary Examiner* — Craig Schneider
*Assistant Examiner* — Umashankar Venkatesan
(74) *Attorney, Agent, or Firm* — Ladas & Parry LLP

(57) ABSTRACT

A hydraulic control valve is provided, which can prevent the occurrence of overload by relieving hydraulic fluid of a return line in which the overload occurs due to an inertial force of a rotator when a hydraulic motor that is operated by the hydraulic fluid supplied from a hydraulic pump stops halfway. The hydraulic control valve includes a valve block in which a first pump path and second pump paths are formed, a spool shiftably coupled to the valve block to control the hydraulic fluid supplied to a hydraulic motor, first and second actuator paths connecting the second pump paths to first and second actuator ports according to the shifting of the spool, tank paths connecting the first and second actuator paths to a hydraulic tank according to the shifting of the spool, first to fourth flow paths in which first to fourth check valves are installed, respectively, a path having one end communicating with a crossing part between the first and third flow paths and the other end communicating with a crossing unit between the second and fourth flow paths, and a relief valve installed in the path to relieve hydraulic fluid in one of the first and second actuator ports in which the overload occurs and to provide a supplement supply of the relieved hydraulic fluid to the other actuator port in which the overload does not occur.

1 Claim, 8 Drawing Sheets

PRIOT ART

HYDRAULIC CONTROL VALVE

CROSS-REFERENCE TO RELATED APPLICATION

This application is based on and claims priority from Korean Patent Application No. 10-2009-99880, filed on Oct. 20, 2009 in the Korean Intellectual Property Office, the disclosure of which is incorporated herein in its entirety by reference.

BACKGROUND OF THE INVENTION

1. Field of the Invention

The present invention relates to a hydraulic control valve which controls hydraulic fluid supplied to a rotator such as a hydraulic motor that is installed in an excavator or the like.

More particularly, the present invention relates to a hydraulic control valve which can prevent the occurrence of overload by relieving hydraulic fluid of a return line in which the overload occurs due to an inertial force of a rotator when a hydraulic motor that is operated by the hydraulic fluid supplied from a hydraulic pump stops halfway.

2. Description of the Prior Art

As illustrated in FIG. 1, a conventional hydraulic control valve includes a valve block 1 in which a first pump path 3 to which hydraulic fluid from a hydraulic pump P is supplied and second pump paths 4 and 5 which are connected in parallel to the first pump path 3 are formed; a spool 2 shiftably coupled to the valve block 1 by pilot signal pressures Pi1 and Pi2 from the outside and shifted to control the hydraulic fluid supplied from the hydraulic pump P to a hydraulic motor (not illustrated); first and second actuator paths 8 and 9 connecting the second pump paths 4 and 5 to first and second actuator ports 6 and 7, respectively, in accordance with the shifting of the spool 2; and a relief valve 10, if overload occurs in either of the first and second actuator ports 6 and 7, relieving the hydraulic fluid in one of the first and second actuator ports 6 and 7 in which the overload occurs and providing a supplement supply of the relieved hydraulic fluid to the other of the first and second actuator ports 6 and 7 in which the overload does not occur.

The operation of the conventional hydraulic control valve as constructed above will now be described with reference to the accompanying drawings.

A) In the case where a spool of a direction change valve is shifted in the right direction as shown in the drawing:

As illustrated in FIGS. 1 and 3, if the pilot signal pressure Pi1 from the outside is supplied to a left port as shown in the drawing, the spool 2 is shifted in the right direction. Hydraulic fluid discharged from the hydraulic pump P flows through the first pump path 3 and the second pump path 4 in order, and then is supplied to the first actuator port 6 via the first actuator path 8. Accordingly, the hydraulic fluid is supplied to the hydraulic motor to rotate the rotator clockwise or counterclockwise.

At this time, hydraulic fluid returning from a hydraulic motor flows into the second actuator port 7, and then returns to a hydraulic tank (not illustrated) via the second actuator path 9 and a tank path 11 in order.

On the other hand, if the spool 2 is shifted to its neutral position while the hydraulic motor is rotated by the hydraulic fluid supplied from the hydraulic pump P, the rotator of the hydraulic motor is unable to stop straight due to an inertial force of the rotator to cause the occurrence of overload in the second actuator port 7.

At this time, the hydraulic fluid on the side of the second actuator port 7 passes through a third check valve 12, and is relieved by the relief valve 10. The relieved hydraulic fluid is supplied to the first actuator path 8 via a second check valve 13, and thus the shortage of hydraulic fluid on the side of the first actuator port 6 can be supplemented.

B) In the case where the spool of the direction change valve is shifted in the left direction as shown in the drawing:

As illustrated in FIGS. 1 and 3, if the pilot signal pressure Pi2 from the outside is supplied to a right port as shown in the drawing, the spool 2 is shifted in the left direction. Hydraulic fluid discharged from the hydraulic pump P flows through the first pump path 3 and the second pump path 5 in order, and then is supplied to the second actuator port 7 via the second actuator path 9. Accordingly, the hydraulic fluid is supplied to the hydraulic motor to rotate the rotator clockwise or counterclockwise.

At this time, hydraulic fluid returning from the hydraulic motor flows into the first actuator port 6, and then returns to the hydraulic tank via the first actuator path 8 and a tank path 14 in order.

On the other hand, if the spool 2 is shifted to its neutral position while the hydraulic motor is rotated by the hydraulic fluid supplied from the hydraulic pump P, the rotator of the hydraulic motor is unable to stop straight due to the inertial force of the rotator to cause the occurrence of overload in the first actuator port 6.

At this time, the hydraulic fluid on the side of the first actuator port 6 passes through a first check valve 15, and is relieved by the relief valve 10. The relieved hydraulic fluid, which is supplied to the second actuator path 9 via a fourth check valve 14, supplements the shortage of hydraulic fluid on the side of the second actuator port 7.

On the other hand, if the overload occurs in the first actuator port 6 or the second actuator port 7 by an external force applied from the outside even in the state where the spool 2 is maintained in its neutral position, the occurrence of the overload can be prevented in the same manner as described above.

As shown in FIG. 2, since the above-described first and third check valves 15 and 12 are mounted on the lower end parts of the control valve, the workability on manufacturing and assembling of the control valve is degraded with the manufacturing cost increased, and thus the competitiveness of the product is weakened in the same industrial field.

In addition, in the case of inspecting the first and third check valves 15 and 12 after installing the control valve in the equipment, it is required to take away the whole control valve from the equipment.

SUMMARY OF THE INVENTION

Accordingly, the present invention has been made to solve the above-mentioned problems occurring in the prior art while advantages achieved by the prior art are maintained intact.

An embodiment of the present invention relates to a hydraulic control valve which can prevent the occurrence of overload by relieving hydraulic fluid of a return line in which the overload occurs due to an inertial force of a rotator when a hydraulic motor stops halfway.

An embodiment of the present invention relates to a hydraulic control valve in which if it is required to disassemble and inspect check valves, only the check valves can be disassembled from a control valve and then be inspected.

In one aspect of the present invention, there is provided a hydraulic control valve, which includes a valve block in which a first pump path to which hydraulic fluid from a hydraulic pump is supplied and second pump paths which are connected in parallel to the first pump path are formed; a spool shiftably coupled to the valve block by pilot signal pressures from the outside and shifted to control the hydraulic fluid supplied from the hydraulic pump to a hydraulic motor; first and second actuator paths connecting the second pump paths to first and second actuator ports, respectively, in accordance with the shifting of the spool; tank paths connecting the first and second actuator paths to a hydraulic tank in accordance with the shifting of the spool; a first flow path of which one end is branched and connected to the first actuator path and in which a first check valve is installed; a second flow path of which one end is branched and connected to the first actuator path and in which a second check valve is installed; a third flow path of which one end is branched and connected to the second actuator path, which communicates with the other end of the first flow path, and in which a third check valve is installed; a fourth flow path of which one end is branched and connected to the second actuator path, which communicates with the other end of the second flow path, and in which a fourth check valve is installed; a path of which one end communicates with a crossing part between the first flow path and the third flow path, and of which the other end communicates with a crossing unit between the second flow path and the fourth flow path; and a relief valve installed in the path, and if overload occurs in either of the first and second actuator ports, relieving hydraulic fluid in the actuator port in which the overload occurs and providing a supplement supply of the relieved hydraulic fluid to the other actuator port in which the overload does not occur.

In the hydraulic control valve according to an embodiment of the present invention, the spool and the first and third check valves may be installed in one block.

The hydraulic control valve as constructed above according to an embodiment of the present invention has the following advantages.

Since the check valves are efficiently arranged to relieve hydraulic fluid of a return line in which the overload occurs due to the inertial force of the rotator when the hydraulic motor stops halfway, the workability on manufacturing of the control valve is improved and thus the manufacturing cost can be reduced.

Also, if it is required to disassemble and inspect the check valves, only the check valves can be simply disassembled from the control valve and then be inspected.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
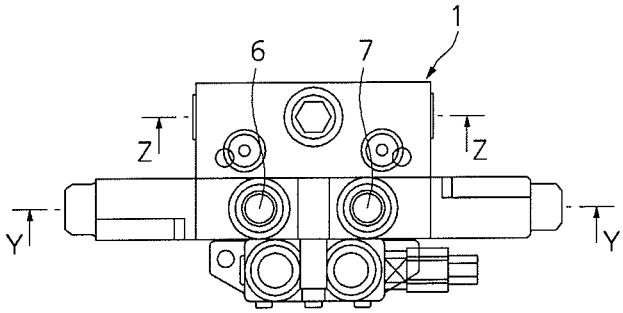
FIG. 1 PRIOR ART
FIG. 1 is a plan view of a hydraulic pressure control valve.

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

As shown in FIGS. 4 to 9, a hydraulic control valve according to an embodiment of the present invention includes a valve block 1 in which a first pump path 3 to which hydraulic fluid from a hydraulic pump P is supplied and second pump paths 4 and 5 which are connected in parallel to the first pump path 3 are formed; a spool 2 shiftably coupled to the valve block 1 by pilot signal pressures Pi1 and Pi2 from the outside and shifted to control the hydraulic fluid supplied from the hydraulic pump P to a hydraulic motor (not illustrated); first and second actuator paths 8 and 9 connecting the second pump paths 4 and 5 to first and second actuator ports 6 and 7, respectively, in accordance with the shifting of the spool 2; tank paths 11 and 14 connecting the first and second actuator paths 8 and 9 to a hydraulic tank (not illustrated) in accordance with the shifting of the spool 2; a first flow path 21 of which one end is branched and connected to the first actuator path 8 and in which a first check valve 20 is installed; a second flow path 23 of which one end is branched and connected to the first actuator path 8 and in which a second check valve 27 is installed; a third flow path 25 of which one end is branched and connected to the second actuator path 9, which communicates with the other end of the first flow path 21, and in which a third check valve 24 is installed; a fourth flow path 26 of which one end is branched and connected to the second actuator path 9, which communicates with the other end of the second flow path 23, and in which a fourth check valve 28 is installed; and a relief valve 10 installed in a path 22, and if overload occurs in either of the first and second actuator ports 6 and 7, relieving hydraulic fluid in the actuator port 6 or 7 in which the overload occurs and providing a supplement supply of the relieved hydraulic fluid to the other actuator port 6 or 7 in which the overload does not occur.

In the hydraulic control valve according to an embodiment of the present invention, the spool 2 and the first and third check valves 20 and 24 may be installed in one block.

In the drawing, the unexplained reference numeral 17 denotes a main relief valve that protects a hydraulic circuit by draining hydraulic fluid to a hydraulic tank when overload that exceeds a predetermined pressure occurs in the hydraulic circuit, and 18 denotes a path that makes the first flow path 21 communicate with the third flow path 25.

Since the construction except for the first and second flow paths 21 and 23 which are branched and connected in parallel to the first actuator path 8, the third and fourth flow paths 25 and 26 which are branched and connected in parallel to the second actuator path 9 and which communicate with the first and second flow paths 21 and 23, respectively, and the first and third check valves 20 and 24 installed in symmetry with the first and third flow paths 21 and 25, respectively, is substantially the same as that of the conventional hydraulic control valve, the detailed description thereof will be omitted, and the same reference numerals are given for the same constituent elements.

Hereinafter, the operation of the hydraulic control valve according to an embodiment of the present invention will be described in detail with reference to the accompanying drawings.

Figure 6:
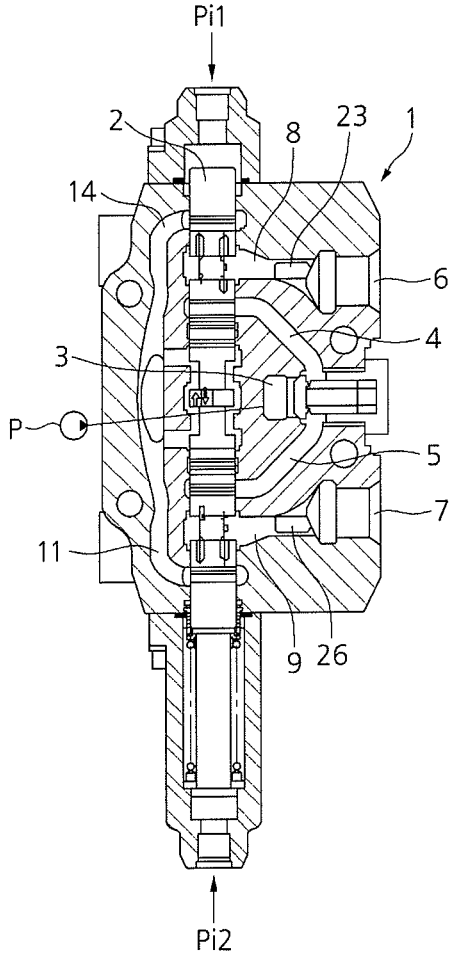
FIG. 6 is a section view taken along line A-A in FIG. 4.
Figure 7:
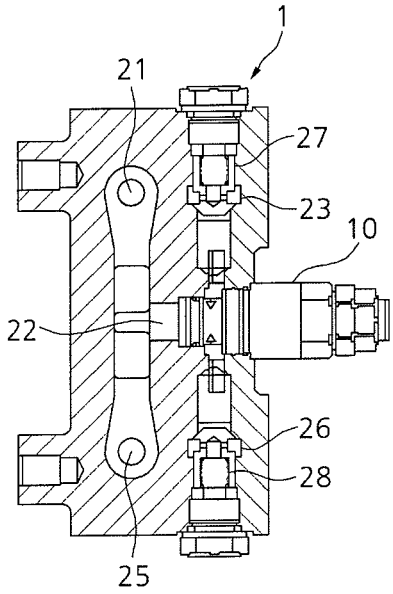
FIG. 7 is a section view taken along line B-B in FIG. 4.
Figure 9:
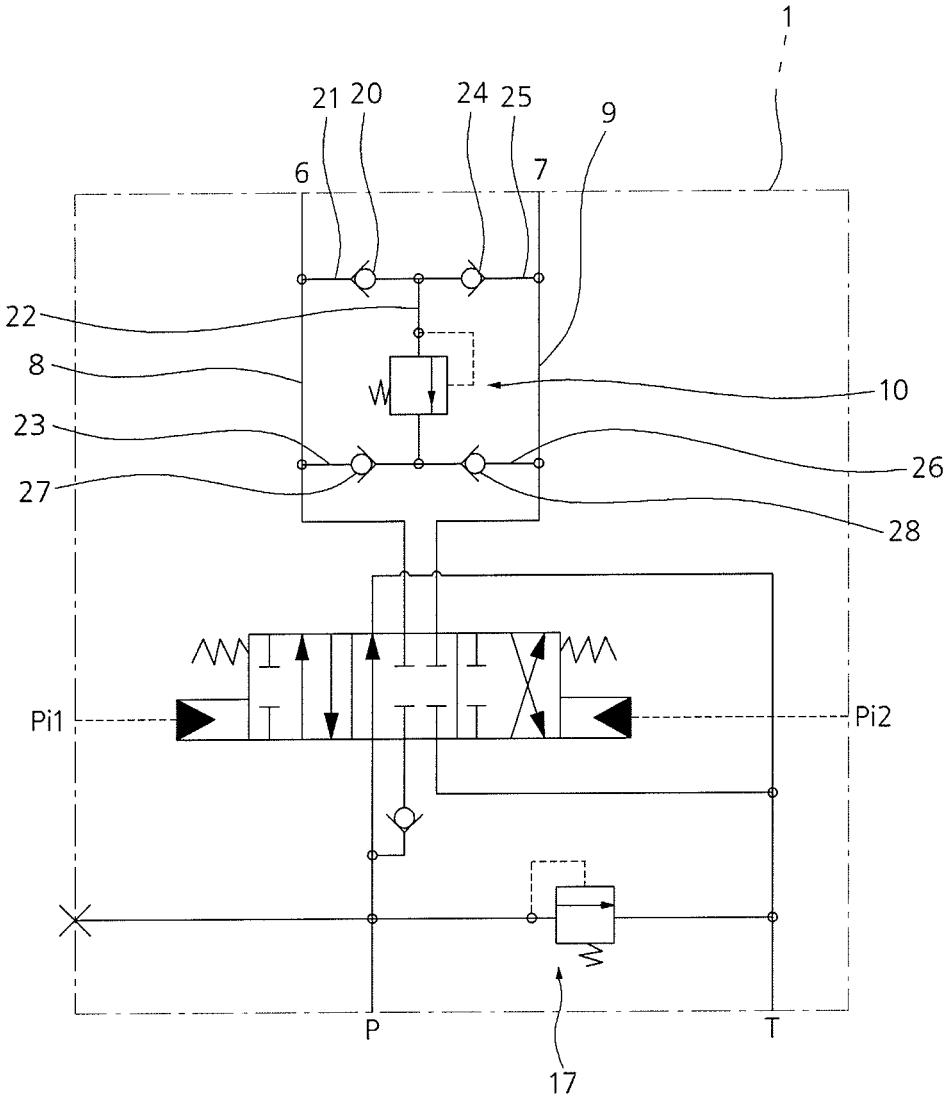
FIG. 9 is a hydraulic circuit diagram of a hydraulic control valve according to an embodiment of the present invention.

A) In the case where a spool of a direction change valve is shifted in the right direction as shown in the drawing:

As illustrated in FIG. 6, if the pilot signal pressure Pi1 from the outside is supplied to an upper port of the control valve, the spool 2 of the direction change valve is shifted in a downward direction as shown in the drawing (in FIG. 9, the pilot signal pressure Pi1 is supplied to a left port of the direction change valve as shown in the drawing, and thus the spool 2 is shifted in the right direction as shown in the drawing).

In this case, hydraulic fluid discharged from the hydraulic pump P flows through the first pump path 3 and the second pump path 4 in order, and then is supplied to the first actuator port 6 via the first actuator path 8. Accordingly, the hydraulic fluid is supplied to the hydraulic motor (not illustrated) to rotate the rotator clockwise or counterclockwise.

At this time, hydraulic fluid returning from the hydraulic motor flows into the second actuator port 7, and then returns to a hydraulic tank via the second actuator path 9 and a tank path 11 in order.

On the other hand, if the spool 2 of the direction change valve is shifted to its neutral position while the hydraulic motor is rotated by the hydraulic fluid supplied from the hydraulic pump P, the rotator of the hydraulic motor is unable to stop straight due to an inertial force of the rotator to cause the occurrence of overload in the second actuator port 7.

At this time, since the hydraulic fluid on the side of the second actuator port 7 passes through a third check valve 24 and is relieved by the relief valve 10, the occurrence of overload in the second actuator port 7 can be prevented. The relieved hydraulic fluid is supplied to the first actuator path 8 via a second check valve 27, and thus the shortage of hydraulic fluid on the side of the first actuator port 6 can be supplemented.

B) In the case where the spool of the direction change valve is shifted in the left direction as shown in the drawing:

As illustrated in FIG. 6, if the pilot signal pressure Pi2 from the outside is supplied to a lower port of the control valve as shown in the drawing, the spool 2 of the direction change valve is shifted in an upward direction as shown in the drawing (in FIG. 9, the pilot signal pressure Pi2 is supplied to a right port of the direction change valve as shown in the drawing, and thus the spool 2 of the direction change valve is shifted in the left direction as shown in the drawing).

Hydraulic fluid discharged from the hydraulic pump P flows through the first pump path 3 and the second pump path 5 in order, and then is supplied to the second actuator port 7 via the second actuator path 9. Accordingly, the hydraulic fluid is supplied to the hydraulic motor (not illustrated) to rotate the rotator clockwise or counterclockwise.

At this time, hydraulic fluid returning from the hydraulic motor flows into the first actuator port 6, and then returns to the hydraulic tank via the first actuator path 8 and a tank path 14 in order.

On the other hand, if the spool 2 is shifted to its neutral position while the hydraulic motor is rotated by the hydraulic fluid supplied from the hydraulic pump P, the rotator of the hydraulic motor is unable to stop straight due to the inertial force of the rotator to cause the occurrence of overload in the first actuator port 6.

At this time, since the hydraulic fluid on the side of the first actuator port 6 passes through a first check valve 20 and is relieved by the relief valve 10, the occurrence of overload in the first actuator port 6 can be prevented. The relieved hydraulic fluid is supplied to the second actuator path 9 via a fourth check valve 28, and thus the shortage of hydraulic fluid on the side of the first actuator port 6 can be supplemented.

On the other hand, if the overload occurs in the first actuator port 6 or the second actuator port 7 by an external force applied from the outside even in the state where the spool 2 of the direction change valve is shifted, the occurrence of the overload can be prevented in the same manner as described above.

Figure 2:
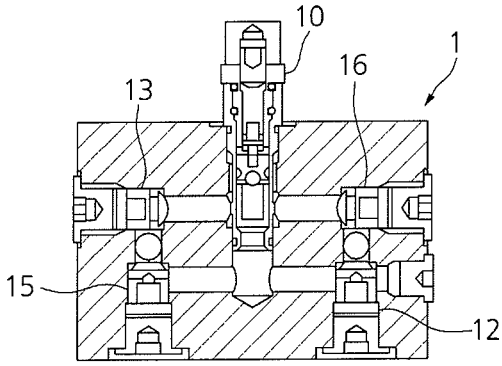
FIG. 2 is a sectional view taken along line Z-Z in FIG. 1.
Figure 3:
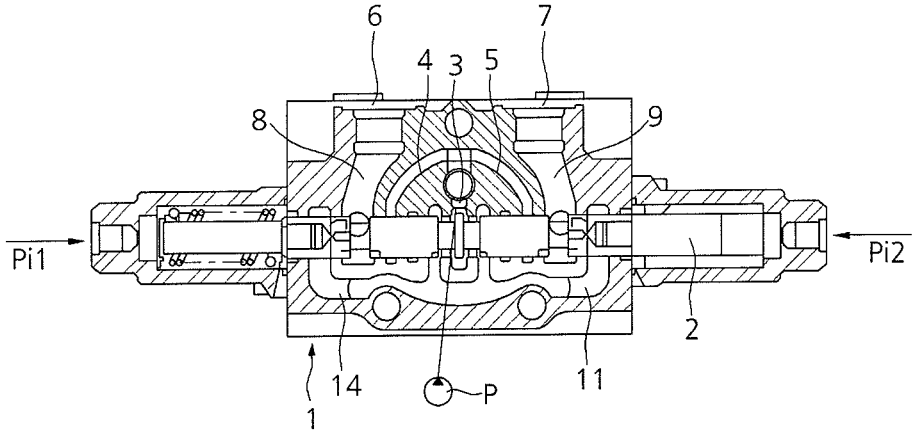
FIG. 3 PRIOR ART
FIG. 3 is a section view taken along line Y-Y in FIG. 1.
Figure 4:
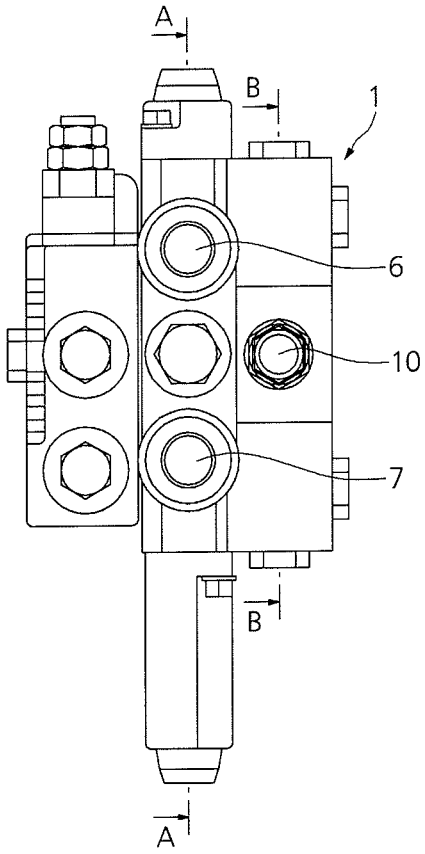
FIG. 4 is a front view of a hydraulic control valve according to an embodiment of the present invention.
Figure 5:
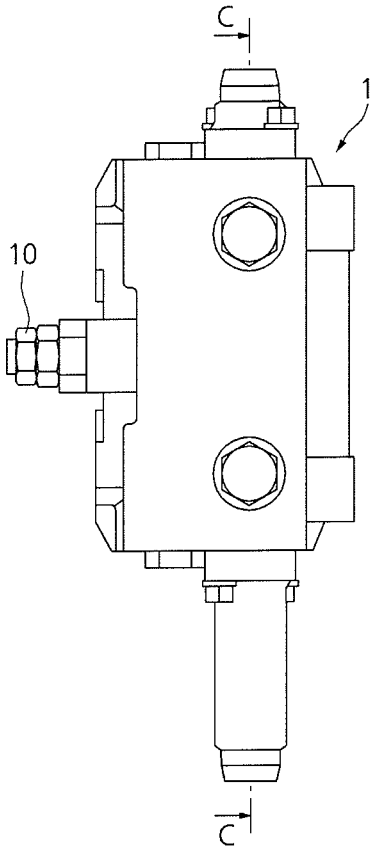
FIG. 5 is a side view of the hydraulic control valve of FIG. 4.
Figure 8:
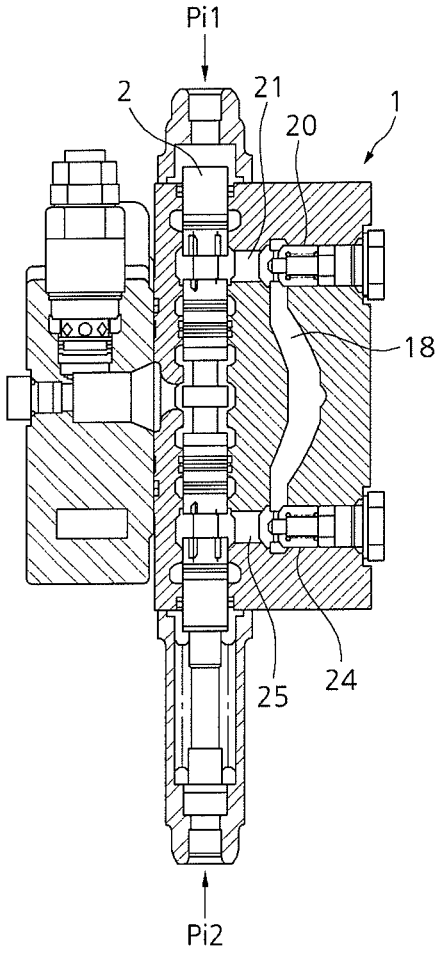
FIG. 8 is a section view taken along line C-C in FIG. 5.

As described above, since the first and third check valves 20 and 24 are mounted on the outer side surface of the control valve as shown in FIG. 8, the cost for manufacturing and assembling the control valve on the equipment is saved to ensure the price competitiveness (in the related art as shown in FIG. 2, the first and third check valves 15 and 12 are installed to be positioned at the lower end of the control valve, and in the case of inspecting the first and third check valves 15 and 12, it is required to take away the whole control valve from the equipment).

In addition, since it is unnecessary to take away the control valve from the equipment in order to inspect the first and third check valves 20 and 24, the inspection work is simplified, and the workability can be improved.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hydraulic control valve comprising:

a valve block in which a first pump path to which hydraulic fluid from a hydraulic pump is supplied and second pump paths which are connected in parallel to the first pump path are formed;

a spool shiftably coupled to the valve block by pilot signal pressures from the outside and shifted to control the hydraulic fluid supplied from the hydraulic pump to a hydraulic motor;

each of first and second actuator paths for connecting the second pump paths to first and second actuator ports, respectively, in accordance with the shifting of the spool;

tank paths connecting the first and second actuator paths to a hydraulic tank in accordance with the shifting of the spool;

a first flow path of which one end is branched and connected to the first actuator path and in which a first check valve is installed;

a second flow path of which one end is branched and connected to the first actuator path and in which a second check valve is installed;

a third flow path of which one end is branched and connected to the second actuator path, which communicates with the other end of the first flow path, and in which a third check valve is installed;

a fourth flow path of which one end is branched and connected to the second actuator path, which communicates with the other end of the second flow path, and in which a fourth check valve is installed;

a path of which one end communicates with a crossing part between the first flow path and the third flow path, and of which the other end communicates with a crossing unit between the second flow path and the fourth flow path; and a relief valve installed in the path, and if overload occurs in either of the first and second actuator ports, relieving hydraulic fluid in the actuator port in which the overload occurs and providing a supplement supply of the relieved hydraulic fluid to the other actuator port in which the overload does not occur, wherein the spool and the first and third check valves are installed in one block.

* * * * *